US008528842B2

(12) United States Patent
Hoang

(10) Patent No.: US 8,528,842 B2
(45) Date of Patent: Sep. 10, 2013

(54) FUEL INJECTOR

(75) Inventor: Anh-Tuan Hoang, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 726 days.

(21) Appl. No.: 11/596,952

(22) PCT Filed: Feb. 21, 2005

(86) PCT No.: PCT/EP2005/050743

§ 371 (c)(1),
(2), (4) Date: May 12, 2008

(87) PCT Pub. No.: WO2005/113973

PCT Pub. Date: Dec. 1, 2005

(65) Prior Publication Data

US 2008/0277505 A1 Nov. 13, 2008

(30) Foreign Application Priority Data

May 18, 2004 (DE) ..... 10 2004 024 533

(51) Int. Cl.
*B05B 1/30* (2006.01)
*F02M 51/00* (2006.01)

(52) U.S. Cl.
USPC ..... 239/585.1; 239/584; 123/472; 123/498

(58) Field of Classification Search
USPC ..... 239/585, 584, 585.1–585.5; 123/472, 123/498
See application file for complete search history.

(56) References Cited

U.S. PATENT DOCUMENTS

| | | | | | |
|---|---|---|---|---|---|
| 3,797,756 | A * | 3/1974 | Voit et al. | 239/585.5 |
| 3,913,537 | A * | 10/1975 | Ziesche et al. | 123/484 |
| 4,164,203 | A * | 8/1979 | Cavanagh | 239/88 |
| 4,311,280 | A * | 1/1982 | Knape | 239/585.2 |
| 4,540,122 | A * | 9/1985 | Teerman | 239/88 |
| 4,708,289 | A * | 11/1987 | Szablewski et al. | 239/125 |
| 4,741,478 | A * | 5/1988 | Teerman et al. | 239/88 |
| 4,984,549 | A * | 1/1991 | Mesenich | 123/472 |
| 5,979,786 | A * | 11/1999 | Longman et al. | 239/5 |
| 6,510,841 | B1 * | 1/2003 | Stier | 123/472 |
| 6,520,434 | B1 * | 2/2003 | Reiter | 239/585.5 |
| 6,745,993 | B2 * | 6/2004 | Mueller | 251/50 |
| 6,857,584 | B2 | 2/2005 | Sebastian et al. | |
| 2003/0102386 | A1 * | 6/2003 | Sebastian et al. | 239/533.2 |
| 2005/0258276 | A1 * | 11/2005 | Delas | 239/533.2 |

FOREIGN PATENT DOCUMENTS

| | | | |
|---|---|---|---|
| DE | 198 16 315 | A | 10/1999 |
| DE | 199 27 900 | A1 | 12/2000 |
| DE | 19927900 | | 12/2000 |
| DE | 100 390 77 | A1 | 2/2002 |
| EP | 1 460 263 | A | 9/2004 |
| JP | 2003502573 | T | 1/2003 |
| JP | 2004506130 | T | 2/2004 |
| WO | WO02084102 | | 10/2002 |

* cited by examiner

*Primary Examiner* — Len Tran
*Assistant Examiner* — Justin Jonaitis
(74) *Attorney, Agent, or Firm* — Kenyon & Kenyon LLP

(57) ABSTRACT

A fuel injector, in particular for the direct injection of fuel into the combustion chamber of a mixture-compressing internal combustion engine having externally supplied ignition, includes an armature which cooperates with a solenoid coil, and a valve needle which is joined to the armature by force-locking and on which a valve-closure member is provided which forms a sealing seat together with a valve-seat surface. The armature is swingingly supported on the valve needle by a spring.

13 Claims, 2 Drawing Sheets

FUEL INJECTOR

FIELD OF THE INVENTION

The present invention relates to a fuel injector.

BACKGROUND INFORMATION

From German Patent Document No. 198 16 315 A1, for instance, a fuel injector is discussed for the direct injection of fuel into the combustion chamber of an internal combustion engine, in particular. The fuel injector includes an armature cooperating with a solenoid coil, and a valve needle which is joined to the armature by force-locking and at which a valve-closure member is provided which forms a sealing seat together with a valve-seat surface. The valve needle has a first limit stop for the armature, which is able to move on the valve needle, the armature being additionally acted upon by a second restoring spring. Moreover, a stationary second limit stop for the armature is provided. The second restoring spring acts upon the armature counter to the lift direction, and in the non-excited state of the solenoid coil holds the armature against the second stop in such a way that the armature and the first stop formed on the valve needle are set apart by a predefined distance.

A particular disadvantage of the fuel injector of German Patent Document No. 198 16 315 A1 may be that, although a prestroke principle is realized which allows an improvement in the valve dynamics during opening of the fuel injector, armature bounce, which induces additional, undesired opening lifts of the valve needle, occurs during closing of the fuel injector when the armature returns to the neutral position.

SUMMARY OF THE INVENTION

In contrast, the fuel injector according to the exemplary embodiment of the present invention has the advantage that the armature is swingingly supported on the valve needle by a correspondingly disposed spring, and a prestroke may thus take place during the opening operation, but the armature is able to swing freely with respect to the valve needle during closing, so that additional opening lifts of the valve needle are able to be prevented.

Furthermore, it is advantageous that the spring is embodied as a simple helical spring und is slipped onto the valve needle.

The spring is advantageously positioned between a sleeve and a flange that is frictionally connected to the valve needle. The sleeve encapsulates the spring and the flange.

Another advantage is that the sleeve is able to be produced in an uncomplicated manner and be installed in the fuel injector on the armature.

Moreover, it is advantageous that a stop ring mounted to the housing is provided, which is used as lower armature stop.

DETAILED DESCRIPTION

Figure 1:
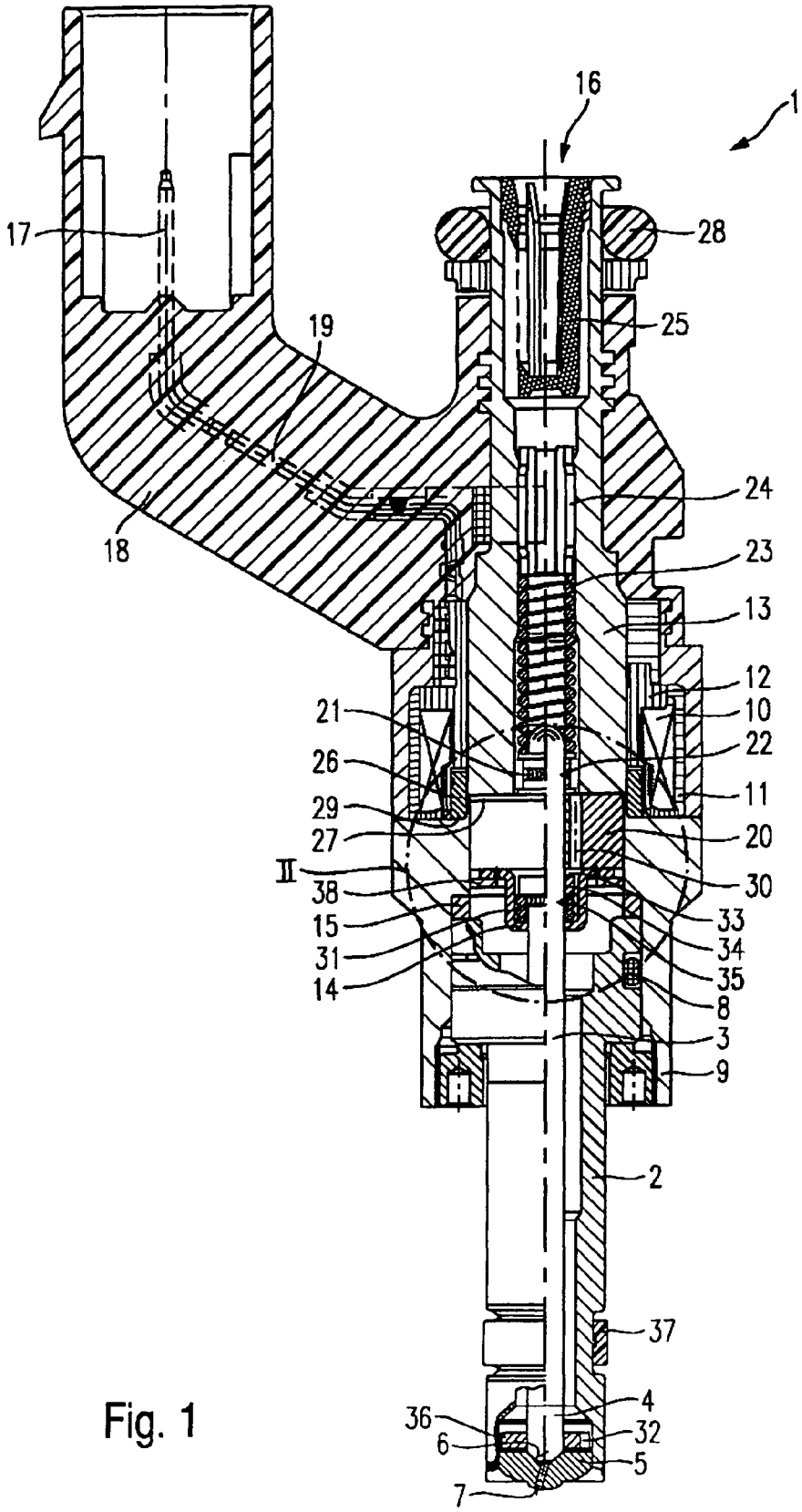
FIG. 1 shows a schematic section through an exemplary embodiment of a fuel injector configured according to the exemplary embodiment of the present invention.

An exemplary embodiment of the present invention is described in the following by way of example. In this context, identical components have been provided with matching reference numerals in all of the figures.

An exemplary embodiment of a fuel injector 1 according to the present invention, shown in FIG. 1, is designed in the form of a fuel injector 1 for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is mechanically linked to a valve-closure member 4, which cooperates with a valve-seat surface 6 disposed on a valve-seat member 5 to form a sealing seat. Fuel injector 1 in the exemplary embodiment is an inwardly opening fuel injector, which is provided with a spray orifice 7. A seal 8 seals nozzle body 2 against an outer pole 9 of a solenoid coil 10. Solenoid coil 10 is encapsulated in a coil housing 11 and wound on a coil brace 12 which rests against an inner pole 13 of solenoid coil 10. Inner pole 13 and outer pole 9 are separated from one another by a constriction 26 and interconnected by a non-ferromagnetic connecting part 29. Solenoid coil 10 is energized via a line 19 by an electric current, which may be supplied via an electrical plug contact 17. Plug contact 17 is enclosed by a plastic coat 18, which is extrudable onto inner pole 13.

An armature 20 is positioned on valve needle 3 in a manner allowing movement. Armature 20 is set apart from a first flange 21 joined to valve needle 3 with force-locking by a welding seam 22, by a prestroke gap 27. Braced on first flange 21 is a restoring spring 23, which is prestressed by a sleeve 24 in the present design of fuel injector 1. A working air gap 33 is formed between a lower stop face of inner pole 13 and armature 20.

Fuel channels 30 and 32 run in armature 20 and along a guide element 36. The fuel is supplied via a central fuel supply 16 and filtered by a filter element 25. Fuel injector 1 is sealed against a fuel distributor (not shown further) by a seal 28 and against a cylinder head (not shown further) by another seal 37.

On the discharge-side of armature 20 is a second flange 34, which is likewise joined to valve needle 3 by force-locking via a welding seam 35.

According to the exemplary embodiment of the present invention, a cup-shaped sleeve 14 is provided, which is situated downstream of armature 20 and permanently connected thereto, in which a spring 31 is situated which is braced between sleeve 14 and second flange 34. A stop ring 38, mounted to the housing, is used as downstream armature stop. The measures according to the exemplary embodiment of the present invention are elucidated in greater detail in the following, with reference to FIG. 2.

In the neutral position of fuel injector 1, return spring 23 acts upon valve needle 3 counter to its lift direction in such a way that valve-closure member 4 is retained in sealing contact against valve seat surface 6. When excited, solenoid coil 10 generates a magnetic field which moves armature 20 in the lift direction, initially counter to the spring force of spring 31, the prestroke, i.e., the free travel of the armature, being defined by a prestroke gap 27 occurring in the neutral position between first flange 21 and armature 20. Following the prestroke travel, armature 20 is pulled to inner pole 13 of solenoid coil 10, counter to the force of restoring spring 23; armature 20 takes along first flange 21, which is welded to valve needle 3, thereby taking it along in the lift direction as well. Valve-closure member 4, which is connected to valve needle 3, lifts off from valve seat surface 6, and the fuel carried via fuel channels 30 and 32 is spray-discharged through spray-discharge orifice 7.

If the coil current is interrupted, following sufficient decay of the magnetic field, armature 20 falls away from inner pole 13 due to the pressure of restoring spring 23, whereupon first flange 21, being joined to valve needle 3, moves in a direction counter to the lift direction. Valve needle 3 is thereby moved in the same direction, causing valve-closure member 4 to set down on valve seat surface 6 and fuel injector 1 to be closed. Sleeve 14 simultaneously sets down on stop ring 38 mounted to the housing.

Figure 2:
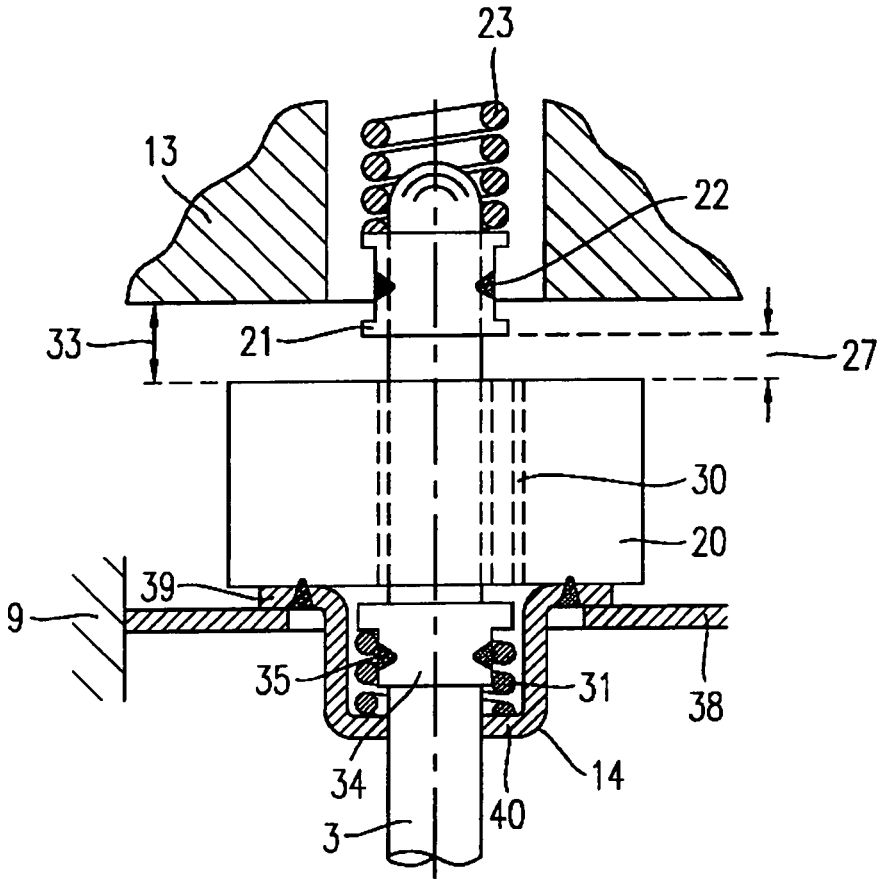
FIG. 2 shows an enlarged cutout from the exemplary embodiment of a fuel injector configured according to the exemplary embodiment of the present invention and shown in FIG. 1, in area II in FIG. 1.

Due to second spring 31, which is disposed between second flange 34 and a base part 40 of sleeve 14 as can be gathered from FIG. 2, armature 20 is situated on valve needle 3 in manner allowing it to swing freely. So-called first-order armature bounces are avoided in that during the closing movement of fuel injector 1 armature 20 is prevented from striking flange 34 when moving in the closing direction. Instead, it is caught by stop ring 38. Armature 20 is thus braked by spring 31 during the closing movement. At the same time, the prestroke principle, which allows the opening dynamics of fuel injector 1 to be improved, is realized as well.

Sleeve 14 is fixedly connected to armature 20 via a collar 39, for instance by welding, soldering or bonding. Stop ring 38 is mounted to the housing by pressing it in or welding it to outer pole 9 of fuel injector 1, for example.

The present invention is not restricted to the exemplary embodiment shown, but also applicable to other forms of fuel injectors 1.

What is claimed is:

1. A fuel injector comprising:

an armature cooperating with a solenoid coil, a working air gap being formed between the armature and an inner pole of the solenoid coil;

a first flange arranged on a supply-side of the armature, a prestroke gap being formed between the first flange and the armature; and a valve needle joined to the armature by force-locking, wherein a valve-closure member, which forms a sealing seat together with a valve-seat surface, is on the valve needle, and wherein the armature is swingingly supported on the valve needle with a spring, wherein a sleeve is situated downstream of the armature, wherein a second flange, which is joined to the valve needle by force-locking, is positioned inside the sleeve, the second flange capable of fitting entirely inside the sleeve, wherein the sleeve is rigidly connected to the armature such that the sleeve and the armature are moved together during a relative motion of the armature on the valve needle.

2. The fuel injector of claim 1, wherein the sleeve has a cup-shaped design and a collar.

3. The fuel injector of claim 2, wherein the sleeve is joined to the armature by welding, via the collar.

4. The fuel injector of claim 1, wherein the sleeve is penetrated by the valve needle in a base part.

5. The fuel injector of claim 1, wherein the spring is situated between the second flange and the sleeve.

6. The fuel injector of claim 5, wherein the spring is penetrated by the valve needle.

7. The fuel injector of claim 5, wherein the spring includes a helical spring.

8. The fuel injector of claim 2, wherein a stop ring is positioned inside the fuel injector, and is downstream of the sleeve collar.

9. The fuel injector of claim 8, wherein the stop ring is mounted to the housing.

10. The fuel injector of claim 8, wherein the sleeve rests against the stop ring in a non-energized state of the solenoid coil.

11. The fuel injector of claim 2, wherein the second flange and the armature are set apart by a clearance having a thickness of the collar of the sleeve.

12. The fuel injector of claim 1, wherein the fuel injector is for directly injecting fuel into a combustion chamber of a mixture-compressing internal combustion engine having externally supplied ignition.

13. The fuel injector of claim 8, wherein the stop ring prevents the armature from striking a second flange.

* * * * *

UNITED STATES PATENT AND TRADEMARK OFFICE

CERTIFICATE OF CORRECTION

PATENT NO. : 8,528,842 B2
APPLICATION NO. : 11/596952
DATED : September 10, 2013
INVENTOR(S) : Anh-Tuan Hoang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1295 days.

Signed and Sealed this
Fifteenth Day of September, 2015

Michelle K. Lee

Michelle K. Lee
*Director of the United States Patent and Trademark Office*